US011819983B2

(12) United States Patent
Kuo

(10) Patent No.: US 11,819,983 B2
(45) Date of Patent: Nov. 21, 2023

(54) TORQUE STRUCTURE

(71) Applicant: Wen-Chin Kuo, Taichung (TW)

(72) Inventor: Wen-Chin Kuo, Taichung (TW)

( * ) Notice: Subject to any disclaimer, the term of this patent is extended or adjusted under 35 U.S.C. 154(b) by 142 days.

(21) Appl. No.: 17/578,731

(22) Filed: Jan. 19, 2022

(65) Prior Publication Data

US 2023/0226671 A1 Jul. 20, 2023

(51) Int. Cl.
*B25B 23/142* (2006.01)
*B25B 23/14* (2006.01)

(52) U.S. Cl.
CPC ..... *B25B 23/1425* (2013.01); *B25B 23/141* (2013.01)

(58) Field of Classification Search
CPC . B25B 23/1425; B25B 23/1427; B25B 23/14; B25B 23/141; B25B 23/142; B25B 23/1422
USPC ..... 81/472, 479
See application file for complete search history.

(56) References Cited

U.S. PATENT DOCUMENTS 2,918,834 A * 12/1959 Cranford ..... B25B 23/1427 81/481
5,537,877 A * 7/1996 Hsu ..... B25B 23/1425 81/479
8,371,194 B2 2/2013 Wu et al.
2009/0266206 A1* 10/2009 Hsu ..... B25B 23/1425 81/479
2012/0132043 A1* 5/2012 Chen ..... B25B 23/1425 81/479
2012/0240735 A1* 9/2012 Tsai ..... B25B 23/1425 81/479
2016/0031070 A1* 2/2016 Ball ..... B25B 23/1427 81/479
2017/0028539 A1* 2/2017 Hsieh ..... B25B 23/141
2017/0095911 A1* 4/2017 Hsieh ..... G01L 25/003

FOREIGN PATENT DOCUMENTS

CN 110370211 A * 10/2019 ..... B25B 23/14

OTHER PUBLICATIONS

CN-110370211-A—Machine Translation. (Year: 2019).*

* cited by examiner

*Primary Examiner* — Brian D Keller
*Assistant Examiner* — Robert C Moore

(57) ABSTRACT

A torque structure includes a first body, a second body, a first elastic member, a retaining unit, an adjusting unit, a mobile unit, and a display unit. The second body has a first guide slot. The first body is rotated relative to the second body to drive the adjusting unit to rotate and move relative to the retaining unit to adjust the torque value. The mobile unit is received in the second body and aligns with the first guide slot. The mobile unit is mounted between the first elastic member and the adjusting unit. The first body drives the adjusting unit which moves the mobile unit which adjusts the compression extent of the first elastic member to adjust the torque value. The display unit display unit detects a position of the mobile unit and indicates a torque value.

11 Claims, 13 Drawing Sheets

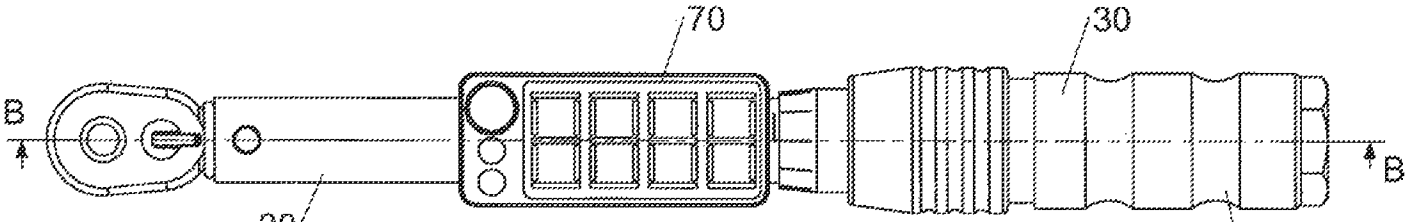
FIG. 14
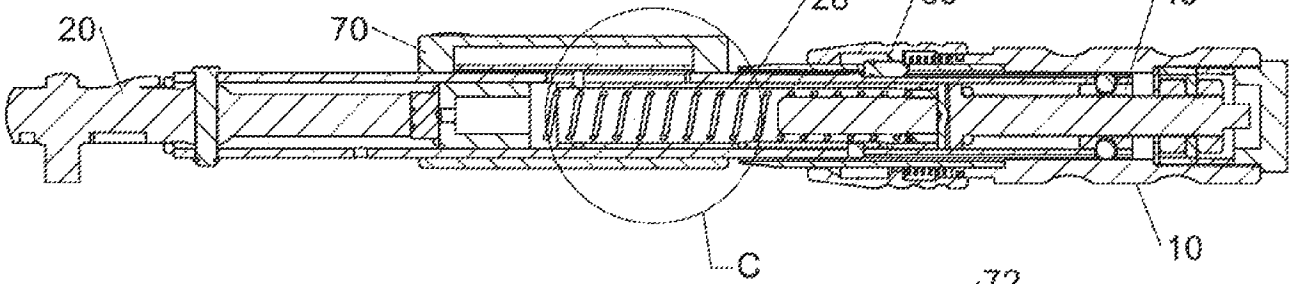
B-B FIG. 15
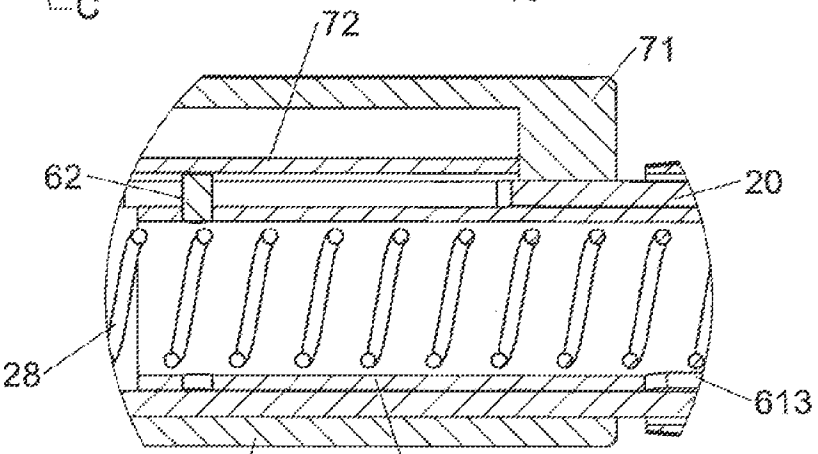
C FIG. 16

TORQUE STRUCTURE

BACKGROUND OF THE INVENTION

1. Field of the Invention

The present invention relates to a hand tool and, more particularly, to a torque structure.

2. Description of the Related Art

A conventional wrench 10 was disclosed in the U.S. Pat. No. 8,371,194 (or Taiwanese Patent Publication No. I372097), and comprises a shank 11, a head 12, a handle 13, a torque assembly 20, a torque-setting device 30 and a torque-measuring device 50. The shank 11 is a tubular element with a slot 14. The handle 13 is attached to an end of the shank 11. The handle 13 includes a window 56 defined therein. A lens 57 is fit in the window 56. The torque assembly 20 is located in the shank 11. The head 12 is attached to an opposite end of the shank 11 via the torque assembly 20. The torque-setting device 30 includes a knob assembly 31, a bolt 35, a pusher 38 and a pin 32. The pusher 38 is located in the shank 11, against the spring 21. The pin 32 is transversely driven in the pusher 38 via the slot 14. The torque-measuring device 50 includes a measurement sleeve 60, a cover 70 and a collar 80. A ring 63 includes teeth engaged with the teeth 62 of the measurement sleeve 60 so that the ring 63 can spin together with the measurement sleeve 60. A scale 64 is provided on a sticker attached to the ring 63. The scale 64 includes notches 54 and numerals 55. The collar 80 includes a reduced section 82 formed at an end and a raised portion 83 formed thereon. A window 51 is defined in the raised portion 83 of the collar 80. A lens 52 is fit in the window 51. The lens 52 is made with a pointer 53. The collar 80 is located around the shank 11. The window 51 is aligned with the scale 64 so that the scale 64 is clearly observable via the lens 52 (FIG. 5). The collar 80 is secured to the shank 11 by screws 81.

However, the conventional wrench has the following disadvantages.

1. The numerals 55 and the numbers in the window 56 are small so that the user cannot identify the numerals 55 and the numbers in the window 56 easily.
2. The knob assembly 31 is rotated to adjust the torque. The knob assembly 31 has a small volume so that the user cannot easily hold and exert a large force on the knob assembly 31. When the torque is increased, the spring 21 is subjected to a larger pressure so that the user has to exert a larger force on the knob assembly 31 to adjust the torque. However, the user cannot easily hold and exert a large force on the knob assembly 31 to adjust the torque, thereby causing inconvenience to the user when having to adjust the torque.
3. The handle 13 is arranged between the notches 54 and the window 56 so that the notches 54 and the window 56 are spaced from each other and obstructed by the handle 13. The user has to watch the notches 54 and the window 56 simultaneously when adjusting the torque so that the arrangement of the notches 54 and the window 56 does not satisfy the ergonomic design, and the user cannot observe the notches 54 and the window 56 clearly, thereby causing inconvenience to the user in adjustment of the torque.

4. The groove 61 is formed in the inner face of the measurement sleeve 60 so that the groove 61 is not worked easily, thereby increasing the cost of fabrication.
5. The groove 61 allows movement of the pin 32 and allows rotation of the ring 63. The distance of movement of the pin 32 cannot match that of rotation of the ring 63 through a cycle. Thus, an error is produced between The distance of movement of the pin 32 cannot match that of rotation of the ring 63 through a cycle.

BRIEF SUMMARY OF THE INVENTION

In accordance with the present invention, there is provided a torque structure comprising a first body, a second body, a first elastic member, a retaining unit, an adjusting unit, a mobile unit, and a display unit. The first body has a first receiving chamber. The second body has a drive portion and a first guide slot. When the first body is rotated relative to the second body, the first body drives the adjusting unit to rotate and move relative to the retaining unit to adjust the torque value. The mobile unit is received in the second body and aligns with the first guide slot. The mobile unit is mounted between the first elastic member and the adjusting unit. When the first body drives the adjusting unit to rotate and move, the adjusting unit pushes and moves the mobile unit, so that the mobile unit adjusts the compression extent of the first elastic member to adjust the torque value. The display unit display unit senses or detects a position of the mobile unit and indicates a torque value.

According to the primary advantage of the present invention, the display unit indicates the torque value at a digital state to facilitate the user inspecting the torque value. The mobile unit is moved with the adjusting unit, and the display unit senses or detects the position of the mobile unit, to indicate the torque value of the torque structure. When the adjusting unit moves in one direction, the mobile unit is moved with the adjusting unit, and when the adjusting unit moves in the other direction, the mobile unit is returned to the original position by the restoring force of the first elastic member.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

FIG. 14 is a top view showing a second operation state of the torque structure in accordance with the preferred embodiment of the present invention.

FIG. 15 is a cross-sectional view of the torque structure taken along line B-B as shown in FIG. 14.

FIG. 16 is a locally enlarged view of the torque structure taken along a circle mark C as shown in FIG. 15.

DETAILED DESCRIPTION OF THE INVENTION

Figure 1:
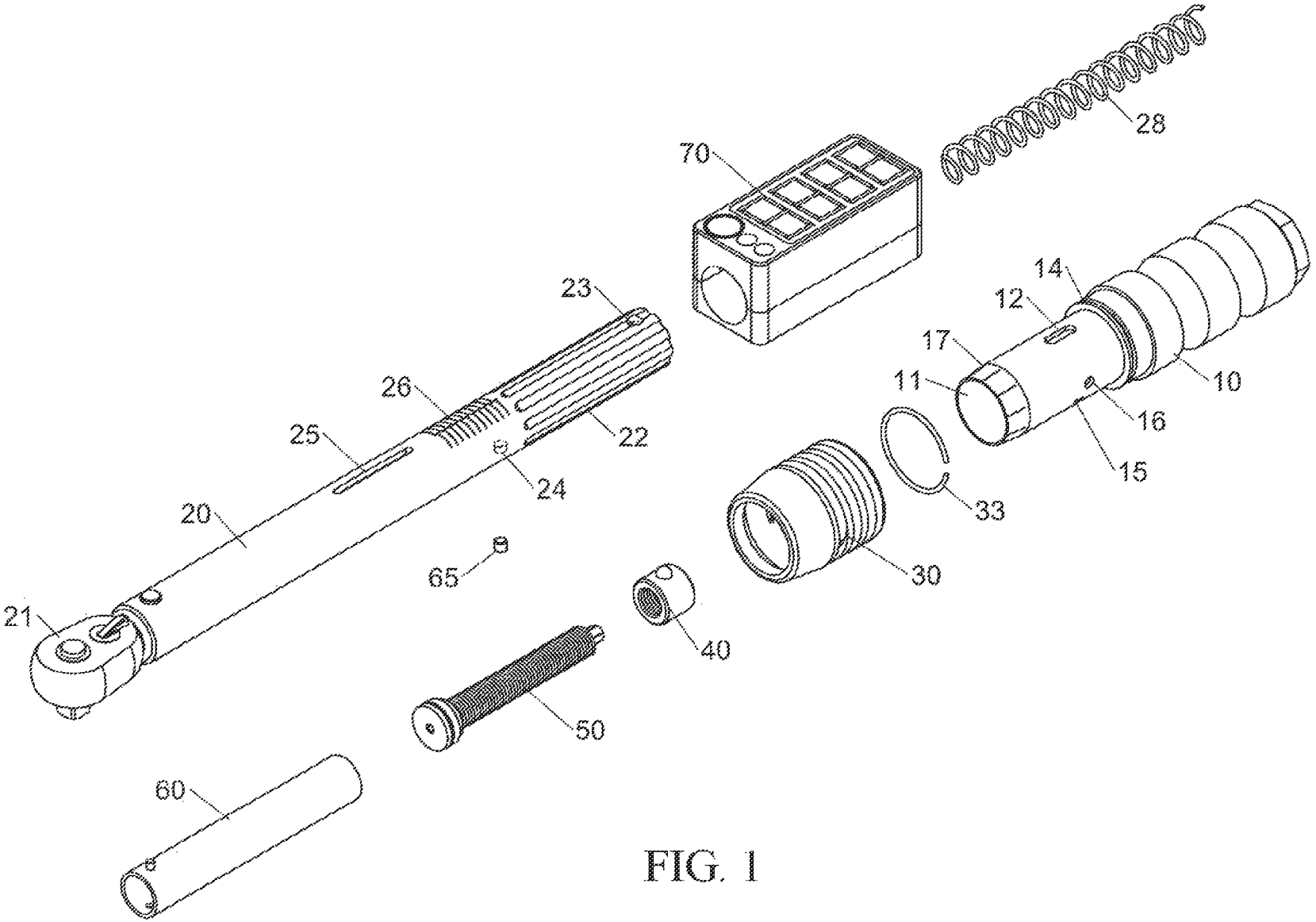
FIG. 1 is an exploded perspective view of a torque structure ire accordance with the preferred embodiment of the present invention.
Figure 2:
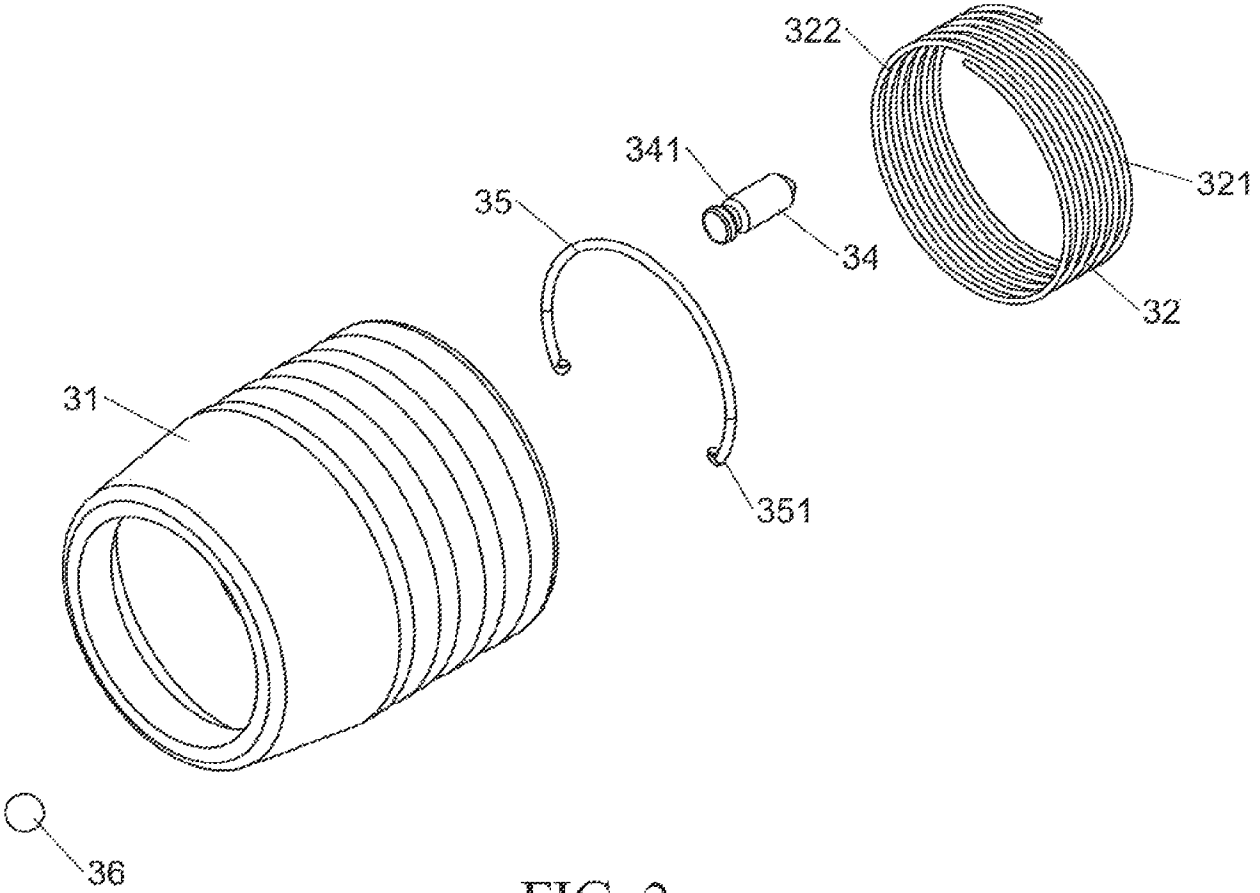
FIG. 2 is an exploded perspective view of a control unit of the torque structure in accordance with the preferred embodiment of the present invention.
Figure 5:
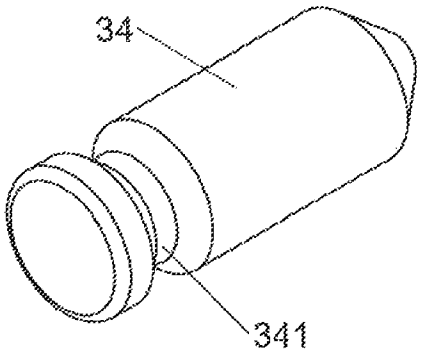
FIG. 5 is a perspective view of a positioning member of the control unit of the torque structure in accordance with the preferred embodiment of the present invention.
Figure 4:
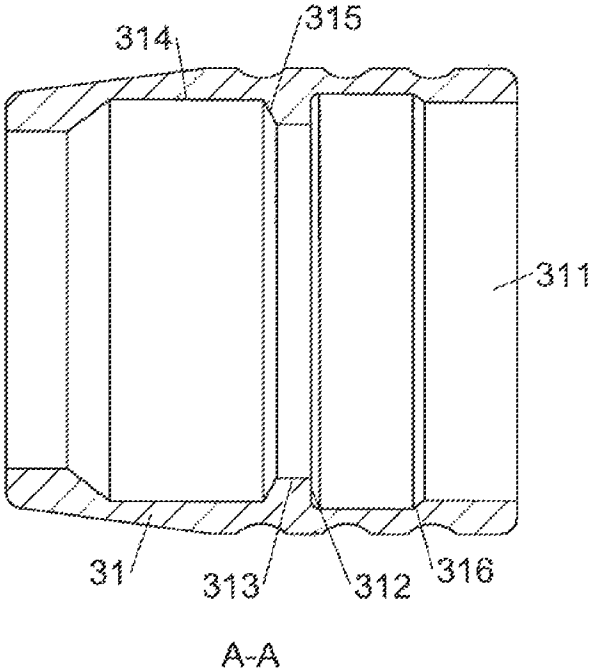
FIG. 4 is a cross-sectional view of the control sleeve of the control unit of the torque structure taken along line A-A as shown in FIG. 3.
Figure 3:
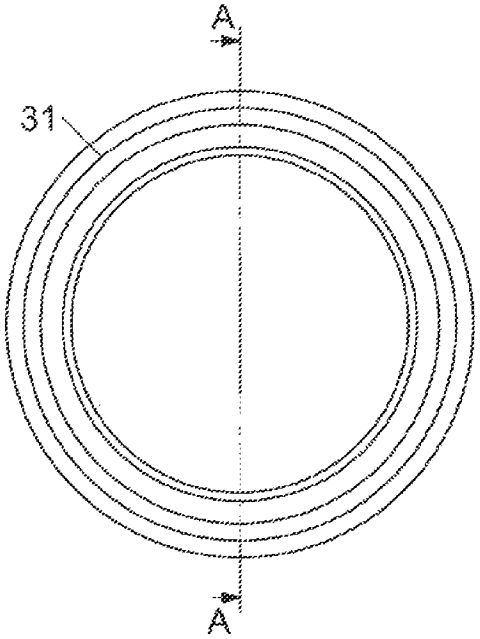
FIG. 3 is a front view of a control sleeve of the control nit of the torque structure of the present invention.
Figure 6:
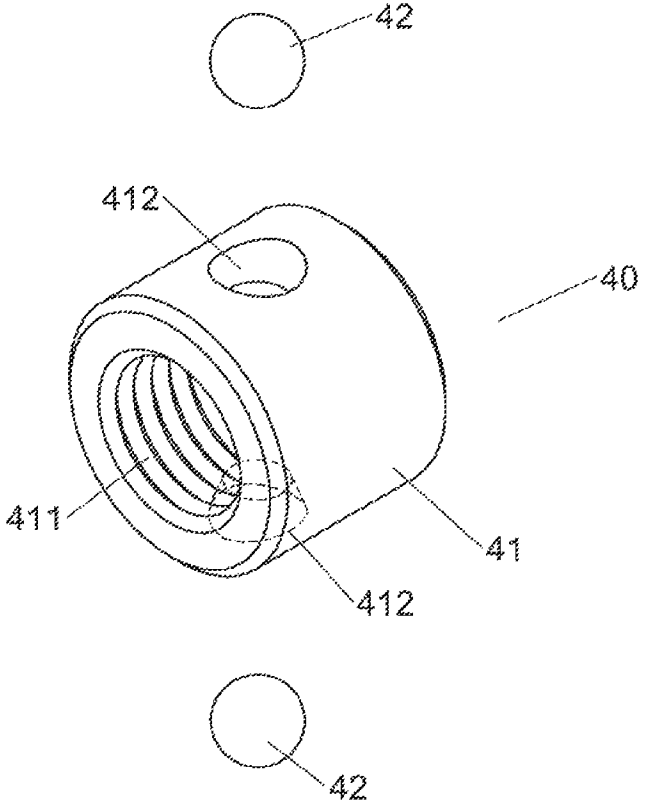
FIG. 6 is an exploded perspective view of a retaining unit of the torque structure in accordance with the preferred embodiment of the present invention.
Figure 7:
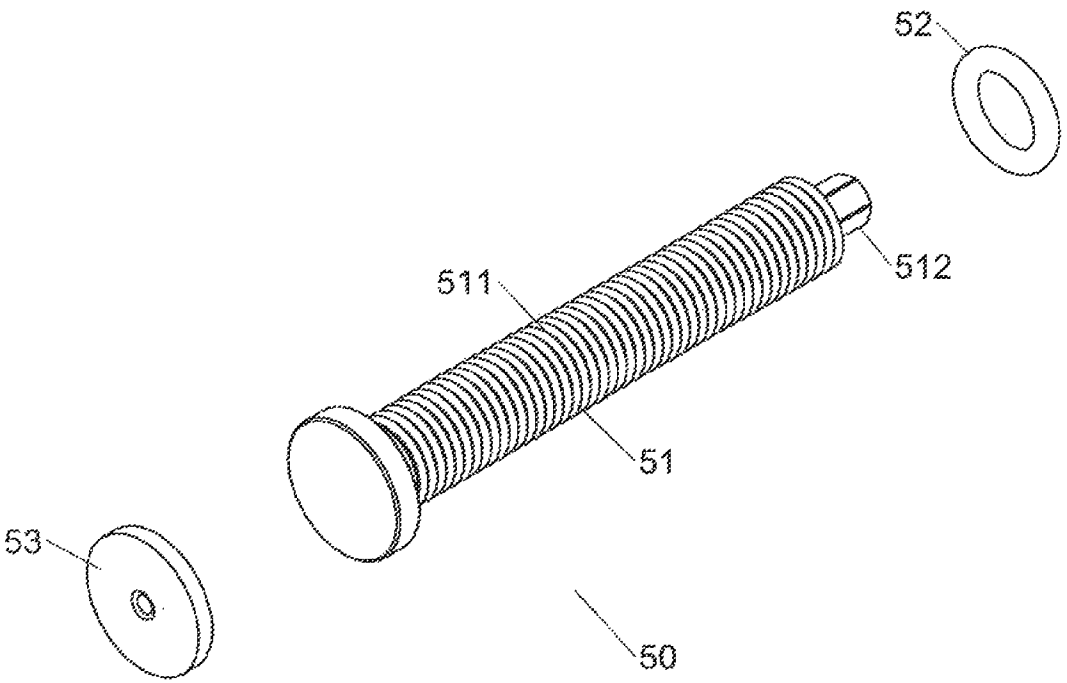
FIG. 7 is an exploded perspective view of an adjusting unit of the torque structure in accordance with the preferred embodiment of the present invention.
Figure 8:
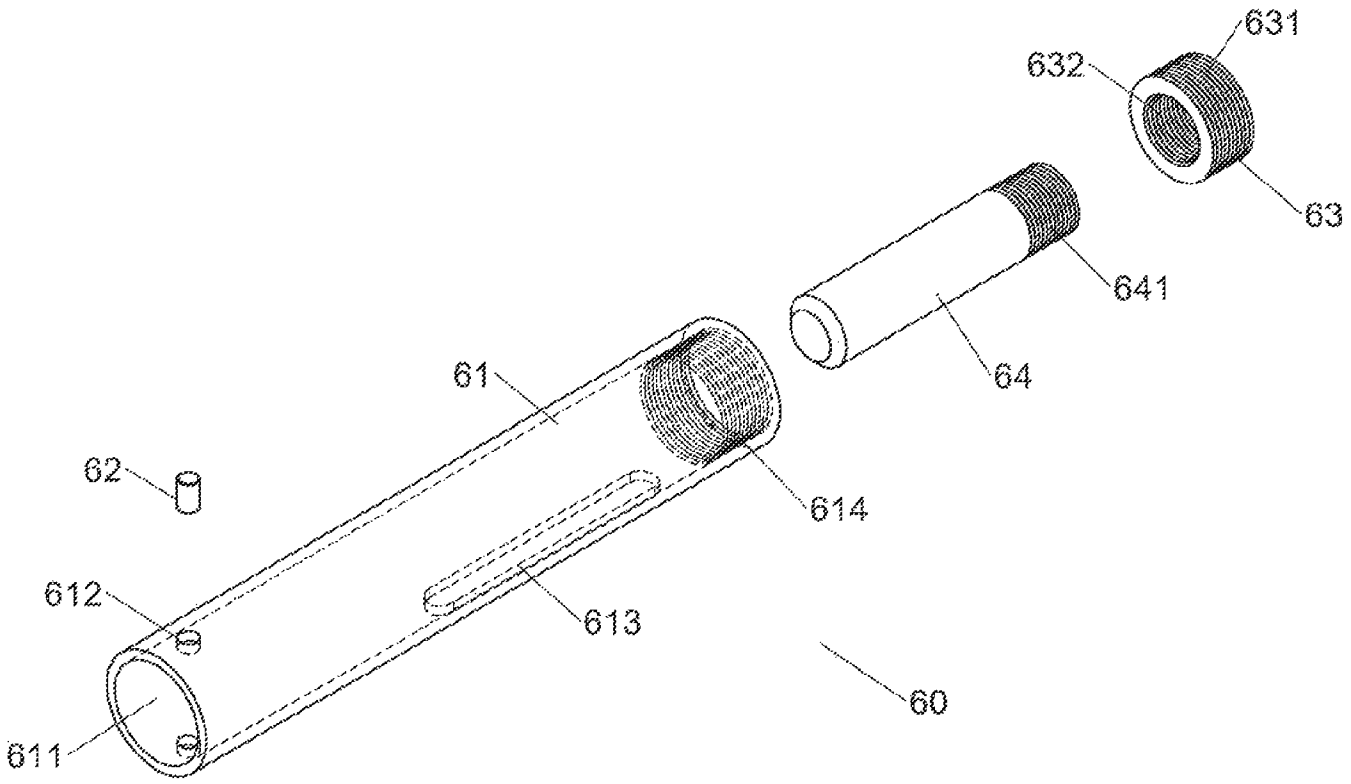
FIG. 8 is an exploded perspective view of a mobile unit of the torque structure in accordance with the preferred embodiment of the present invention.
Figure 9:
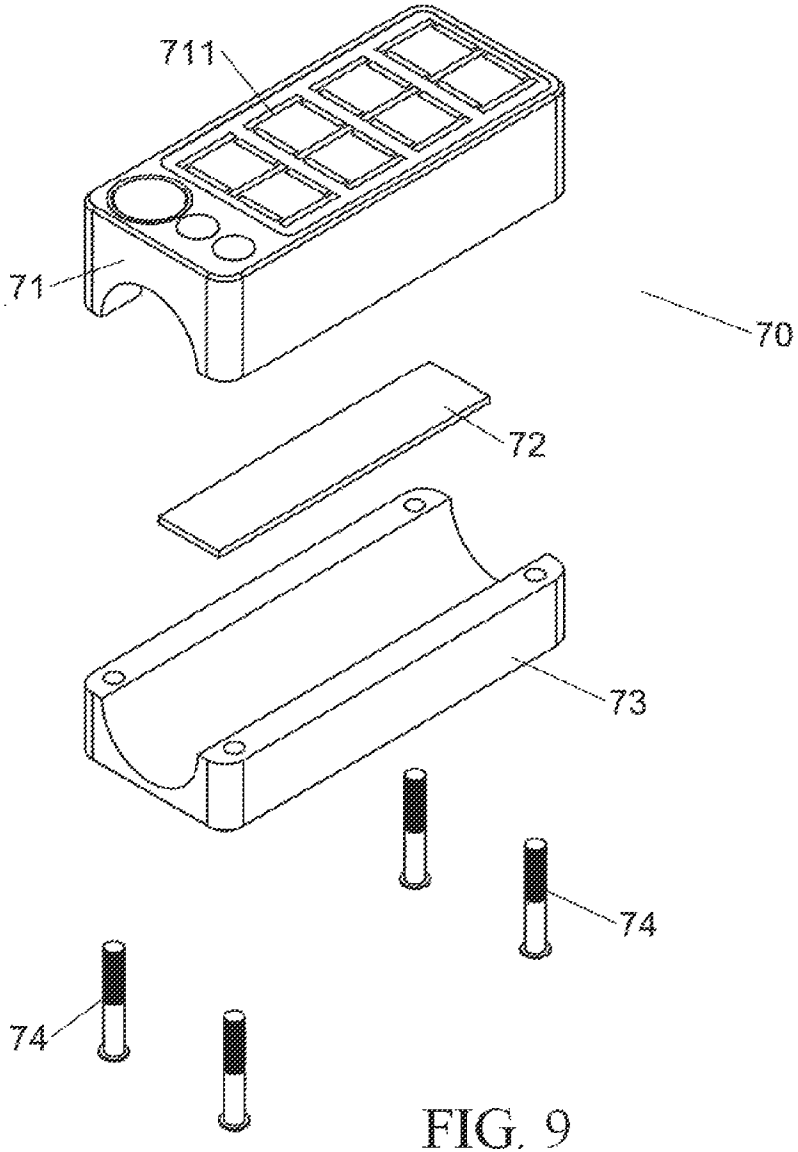
FIG. 9 is an exploded perspective view of a display unit of the torque structure in accordance with the preferred embodiment of the present invention.
Figure 10:
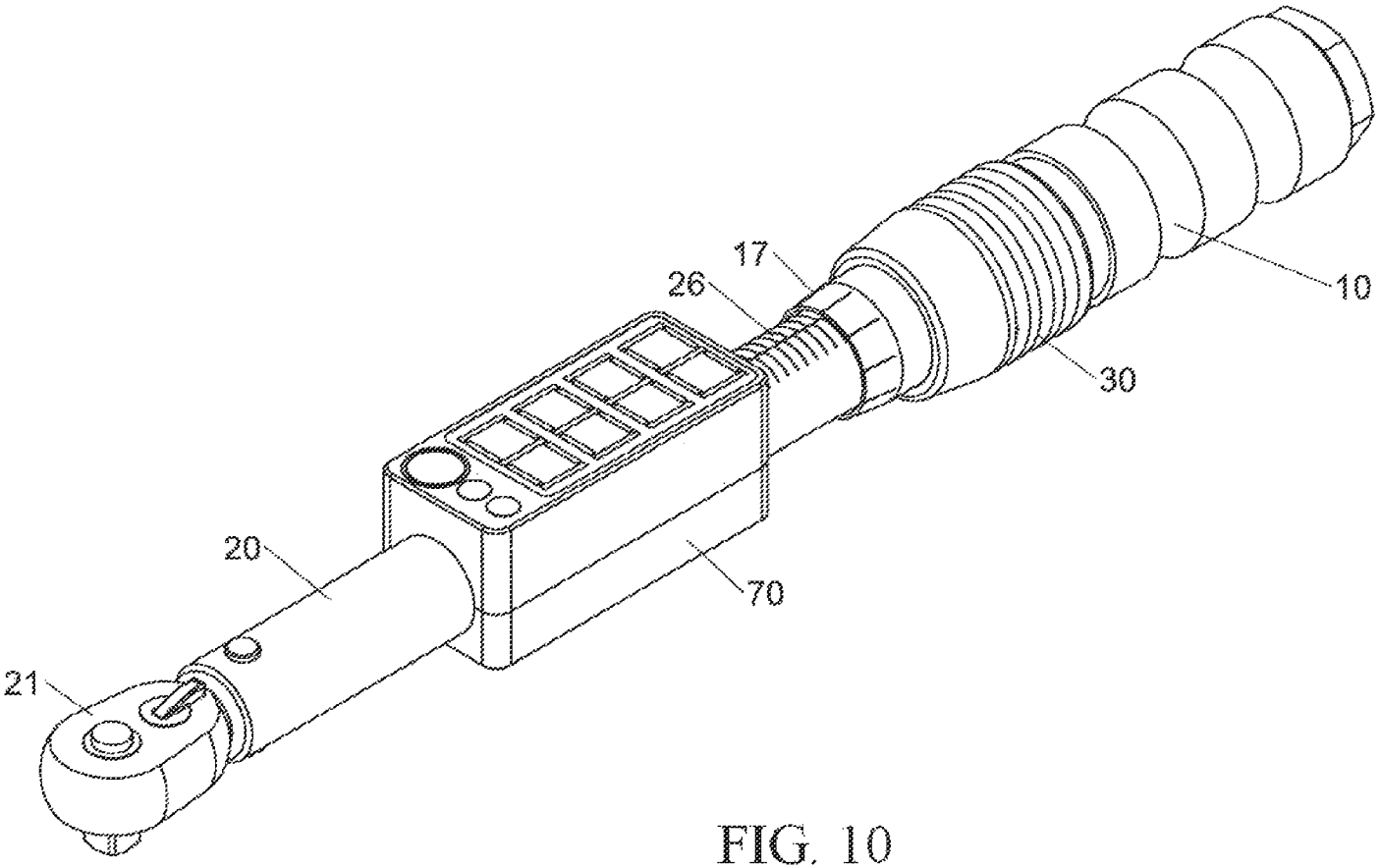
FIG. 10 is a perspective view of the torque structure in accordance with the preferred embodiment of the present invention.
Figure 11:
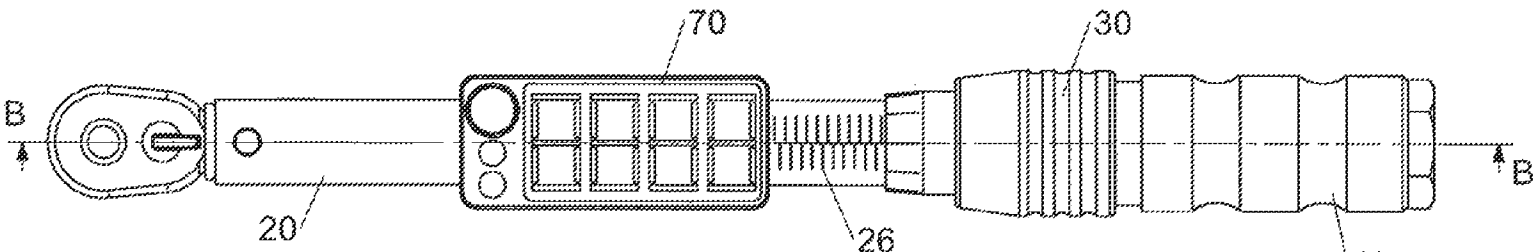
FIG. 11 is a top view showing a first operation state of the torque structure in accordance with the preferred embodiment of the present invention.
Figure 12:
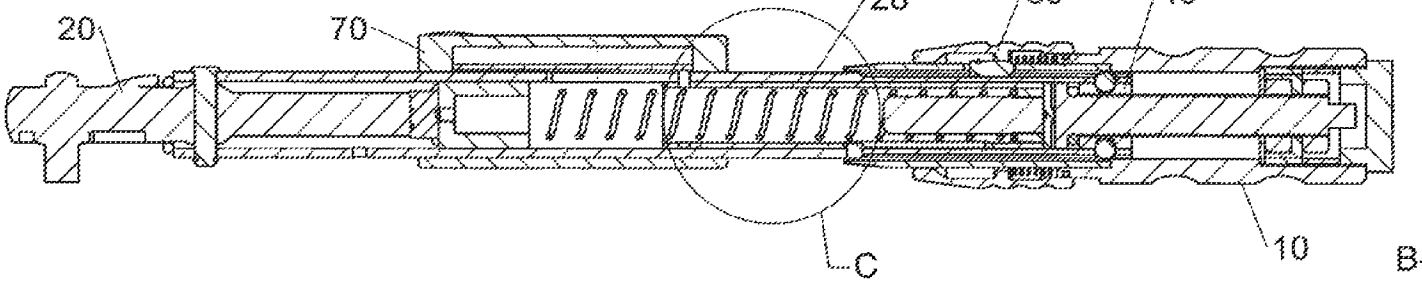
FIG. 12 is a cross-sectional view of the torque structure taken along line B-B as shown in FIG. 11.
Figure 13:
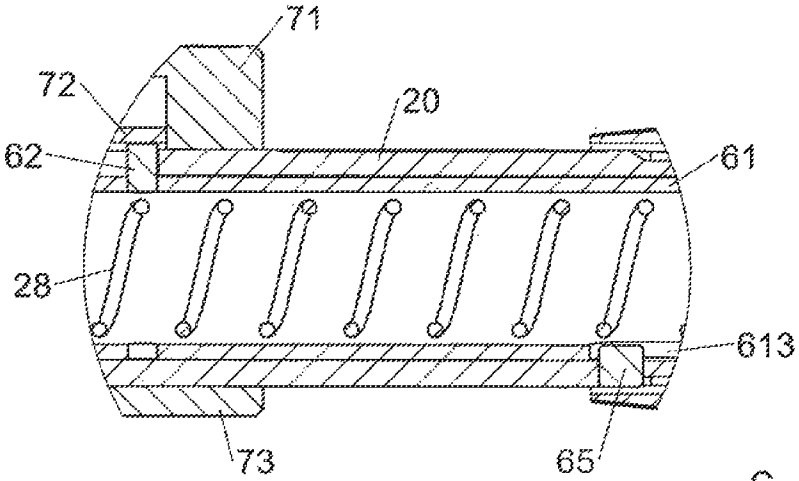
FIG. 13 is a locally enlarged view of the torque structure taken along a circle mark C as shown in FIG. 12.

Referring to the drawings and initially to FIGS. 1-10, a torque structure in accordance with the preferred embodiment of the present invention comprises a first body 10, a second body 20, a first elastic member 28, a control unit 30, a retaining unit (or holder) 40, an adjusting unit 50, a mobile (or movable) unit 60, and a display unit 70.

The first body 10 is a circular rod having an end provided with a handle. The first body 10 has an interior provided with a first receiving chamber 11. The first receiving chamber 11 has a circular shape. The first body 10 is provided with a slot 12 connected to the first receiving chamber 11. The slot 12 has an elongate shape. The first body 10 is provided with a first annular groove 14. The first body 10 is provided with two receiving recesses 15 that are symmetrical relative to the slot 12. The first body 10 is provided with a ball hole 16 connected to the first receiving chamber 11. The ball hole 16 and the slot 12 form an angle of ninety degrees (90°) therebetween relative to an axis of the first body 10. The ball hole 16 has a circular shape and is arranged beside one of the two receiving recesses 15. The first body 10 is provided with a first indication portion 17 including multiple scales that are arranged annularly and spaced from each other.

The second body 20 is assembled with the first body 10. Preferably, the second body 20 is pivotally connected with the first body 10. The second body 20 is partially received in the first receiving chamber 11. The second body 20 has a first end provided with a drive portion 21. The drive portion 21 protrudes from the first body 10. The drive portion 21 is a tetragonal head or a wrench head. The second body 20 has a second end having a peripheral face provided with a plurality of positioning channels 22 hidden in the first receiving chamber 11. The positioning channels 22 are arranged annularly about an axis of the second body 20 and are spaced from each other. The second body 20 has twelve or twenty positioning channels 22. Each of the positioning channels 22 has an arcuate shape. The positioning channels 22 are distant from the drive portion 21. The second body 20 is provided with a plurality of first securing portions 23 arranged on the positioning channels 22. The first securing portions 23 are arranged annularly about the axis of the second body 20 and are spaced from each other. The second body 20 has two first securing portions 23 opposite to each other. Each of the first securing portions 23 is a circular hole and hidden in the first receiving chamber 11. The second body 20 is provided with a first receiving bole 24 having a circular shape and hidden in the first receiving chamber 11. The second body 20 is provided with a first guide slot 25 extending in a lengthwise direction of the second body 20. The first guide slot 25 is located between the drive portion 21 and the positioning channels 22 and has an elongate shape. The second body 20 is provided with a second indication portion 26 including multiple scales arranged linearly in the lengthwise direction of the second body 20. The first body 10 is rotated relative to the second body 20 until the scales of the first indication portion 17 align with the scales of the second indication portion 26 to indicate a torque value of the torque wrench. The second indication portion 26 is located between the positioning channels 22 and the first guide slot 25.

The first elastic member 28 is received in and elastically pressing the second body 20. The second body 20 has a torque slip function and is released from the drive portion 21 when reaching a preset torque value by provision of the first elastic member 28.

The control unit 30 is mounted on the first body 10 and movable between a locking position where the first body 10 cannot be rotated relative to the second body 20 so that the torque state cannot be adjusted, and an unlocking position where the first body 10 can be rotated relative to the second body 20 so that the torque state can be adjusted. The control unit 30 includes a control sleeve 31, a second elastic member 32, a first ring 33, a positioning member 34, a second ring 35, and a ball 36.

The control sleeve 31 is a metal ring mounted on the first body 10 and movable axially on the first body 10 between a locking position and an unlocking position. The control sleeve 31 has an interior provided with a spring recess 311. The spring recess 311 extends to a rear end of the control sleeve 31 and forms an opening facing the handle of the first body 10. The spring recess 311 has a bottom provided with a abutting edge 312. The control sleeve 31 is provided with a first peripheral face 313 and a second peripheral face 314. The abutting edge 312 is arranged between the spring recess 311 and the first peripheral face 313. The first peripheral face 313 has a diameter less than that of the spring recess 311 and is arranged between the abutting edge 312 and the second peripheral face 314. The second peripheral face 314 has a diameter more than that of the first peripheral face 313. The control sleeve 31 is provided with a first conic groove 315 which is arranged between the first peripheral face 313 and the second peripheral face 314 and is enlarged from the first peripheral face 313 to the second peripheral face 314. The first peripheral face 313 is arranged between the abutting edge 312 and the first conic groove 315, The control sleeve 31 is provided with a second conic groove 316 which is arranged in the spring recess 311. The second conic groove 316 is enlarged from the opening of the spring recess 311 to the abutting edge 312. The abutting edge 312 is arranged between the first peripheral face 313 and the second conic groove 316. Thus, the spring recess 311, the second conic groove 316, the abutting edge 312, the first peripheral face 313, the first conic groove 315, and the second peripheral face 314 are arranged serially in the control sleeve 31.

The second elastic member 32 is mounted on the first body 10 and elastically biased against the control sleeve 31 to push the control sleeve 31 from the unlocking position to the locking position. The second elastic member 32 is received in the spring recess 311 and has a first end 321 elastically pressing the first body 10 and a second end 322 elastically pressing the abutting edge 317.

The first ring 33 is mounted in the first annular groove 14 and hidden in the control sleeve 31. The first ring 33 is elastically expandable outward. The first ring 33 rests on a peripheral face of the spring recess 311 when the control sleeve 31 is moved axially to the locking position, and is expanded outward to rest on the second conic groove 316 when the control sleeve 31 is moved axially to the unlocking position.

The positioning member 34 is made of metal and has a cylindrical shape. The positioning member 34 is received in the slot 12 and hidden in the control sleeve 31. The positioning member 34 is releasably locked in one of the positioning channels 22. The positioning member 34 is provided with a second annular groove 341 and a conic portion formed on two ends thereof. The conic portion is directed toward the second elastic member 32.

The second ring 35 is mounted on the first body 10 and the second annular groove 341 and has an elastic restoring force. The second ring 35 has two receiving portions 351 formed on two ends thereof and received in the two receiving recesses 15 so that the second ring 35 is secured to the first body 10 without detachment. The positioning member 34 is limited by the second ring 35 which prevents the positioning member 34 from being detached from the slot 12.

The ball 36 is received in the ball hole 16 and hidden in the control sleeve 31. The ball 36 rests on the first conic groove 315 of the control sleeve 31. The control sleeve 31 is limited by the ball 36 which prevents the control sleeve 31 from being detached from the first body 10.

When the control sleeve 31 is situated at the locking position, the second elastic member 32 pushes the control sleeve 31 toward the first pivot portion 22, so that the first ring 33 rests on the peripheral face of the spring recess 311. One end of the positioning member 34 is pressed by the first peripheral face 313, and the positioning member 34 is partially retracted into the slot 12, so that the positioning member 34 is locked in one of the positioning channels 22. Thus, the first body 10 and the second body 20 are locked by the positioning member 34, so that the first body 10 cannot be rotated relative to the second body 20. The other end of the positioning member 34 aligns with the second peripheral face 314 and the first conic groove 315, and the ball 36 partially protrudes from the ball hole 16 and rests on the first conic groove 315.

When the control sleeve 31 is moved on the first body 10 in a direction opposite to the second body 20 toward the unlocking position, the second elastic member 32 is compressed by the abutting edge 312, and the first ring 33 is detached from the peripheral face of the spring recess 311 so that the first ring 33 is expanded outward and rests on the second conic groove 316, and the control sleeve 31 is situated at the unlocking position by the first ring 33. One end of the positioning member 34 is detached from the first peripheral face 313, the positioning member 34 is only restricted by the second ring 35, and the ball 36 is distant from the first conic groove 315, so that the first body 10 can be rotated relative to the second body 20, and the positioning member 34 is moved on the second body 20 and positioned in any one of the positioning channels 22. The positioning member 34 is pushed by the wall of the second body 20, and the second ring 35 is pushed and expanded outward by the positioning member 34 when the first body 10 is rotated relative to the second body 20. When the positioning member 34 is moved from one to another one of the positioning channels 22, the positioning member 34 is pressed inward by the restoring force of the second ring 35, so that the positioning member 34 is retracted into another one of the positioning channels 22. Thus, a clear sound is produced when the positioning member 34 is forced into and locked in each of the positioning channels 22 to provide an audio indication to the user.

The retaining unit 40 is assembled with the second body 20. The retaining unit 40 cannot be moved or rotated relative to the second body 20. The retaining unit 40 is received in the second body 20 and includes a fixed seat 41, and a plurality of securing members 42.

The fixed seat 41 has a tubular shape and is assembled with the second body 20. The fixed seat 41 cannot be moved or rotated relative to the second body 20. The fixed seat 41 is hidden in the second body 20 and distant from the drive portion 21. The fixed seat 41 is provided with an engaging portion 411 extending through the fixed seat 41. The engaging portion 411 is a circular internal thread. The fixed seat 41 is provided with a plurality of second securing portions 412 aligning with the first securing portions 23. The second securing portions 412 have a number equal to that of the first securing portions 23. The fixed seat 41 has two second securing portions 412.

The securing members 42 are mounted on the first securing portions 23 and the second securing portions 412, such that the fixed seat 41 is secured in and is not detached from the second body 20. The securing members 42 have a number equal to that of the first securing portions 23 and that of the second securing portions 412. Preferably, each of the securing members 42 is a pin or a ball.

The adjusting unit 50 is assembled with the first body 10, the second body 20, and the retaining unit 40. When the first body 10 is rotated relative to the second body 20, the first body 10 drives the adjusting unit 50 to rotate and move relative to the retaining unit 40, so that the adjusting unit 50 is moved axially in the second body 20 to adjust the torque value. The adjusting unit 50 includes an adjusting member 51, a first washer 52, and a second washer 53.

The adjusting member 51 is mounted in the second body 20 and extends through the engaging portion 411. The adjusting member 51 is rotated and moved in the second body 20 and extends through the engaging portion 411. The adjusting member 51 is provided with a first screwing portion 511. The first screwing portion 511 is partially received in the second body 20 and engages the engaging portion 411. The adjusting member 51 is assembled with the first body 10. When the first body 10 is rotated relative to the second body 20, the first body 10 drives the adjusting member 51 which drives the first screwing portion 511 which is rotated and moved in the engaging poi 411. The first screwing portion 511 is an external thread. The adjusting member 51 has a first end provided with a mounting portion 512 received in the first receiving chamber 11. The mounting portion 512 has a polygonal shape. Preferably, the mounting portion 512 has a hexagonal shape.

The first washer 52 is received in the second body 20. The first washer 52 is mounted on the adjusting member 51 and rests on a second end of the adjusting member 51. The first washer 52 is arranged between the adjusting member 51 and the fixed seat 41 to prevent the adjusting member 51 from hitting the fixed seat 41 during a linear displacement of the adjusting member 51.

The second washer 53 is received in the second body 20 and rests on the second end of the adjusting member 51. The second washer 53 is spaced from the first washer 52. The second washer 53 is a disk having a convex portion and a concave portion.

The mobile unit 60 is received in the second body 20 and aligns with the first guide slot 25. The first elastic member 28 is elastically biased between the second body 20 and the mobile unit 60. The mobile unit 60 is mounted between the first elastic member 28 and the adjusting unit 50. When the first body 10 drives the adjusting unit 50 to rotate and move, the adjusting unit 50 pushes and moves the mobile unit 60, so that the mobile unit 60 adjusts a compression extent of the first elastic member 28 to regulate the torque value. The mobile unit 60 is moved linearly. Alternative, the mobile unit 60 is rotated and moved in the second body 20. When the adjusting unit 50 moves in one direction, the mobile unit 60 is moved with the adjusting unit 50, and when the adjusting unit 50 moves in the other direction, the mobile unit 60 is returned to an original position by a restoring force of the first elastic member 28. The mobile unit 60 includes a first movable member 61, a first sensor (or detector) 62, a second movable member 63, a third movable member 64, and a limit member 65.

The first movable member 61 is received in the second body 20 and provided with a second receiving chamber 611. The first elastic member 28 is received in the second receiving chamber 611. The second receiving chamber 611 extends through the first movable member 61 and has a circular shape. The first movable member 61 is provided with a second receiving hole 612 aligning with the first guide slot 25. The second receiving hole 612 has an axis perpendicular to that of the first movable member 61. The second receiving hole 612 has a circular shape. The first movable member 61 is provided with a second guide slot 613 aligning with the first receiving hole 24. The second guide slot 613 has an elongate shape and extends in a lengthwise direction of the first movable member 61. The second receiving chamber 611 is provided with a second screwing portion 614 distant from the second receiving hole 612. The second guide slot 613 is arranged between the second receiving hole 612 and the second screwing portion 614. The second screwing portion 614 is an internal thread. The first movable member 61 has a tubular shape.

The first sensor 62 is assembled with the first movable member 61. The first sensor 62 has a first end mounted in the second receiving hole 612 and a second end slidably mounted in the first guide slot 25. The first sensor 62 slides linearly in the first guide slot 25. The mobile Unit 60 is moved linearly by restriction of the first sensor 62.

The second movable member 63 is assembled with and hidden in the first movable member 61. The first elastic member 28 is elastically biased between the second body 20 and the second movable member 63 of the mobile unit 60. The second movable member 63 has an outer peripheral face provided with a third screwing portion 631 screwed with the second screwing portion 614 so that the second movable member 63 is secured to and will not be detached from the first movable member 61. The third screwing portion 631 is an external thread. The second movable member 63 has an inner peripheral face provided with a fourth screwing portion 632. The fourth screwing portion 632 is an internal thread.

The third movable member 64 is received in the second receiving chamber 611 and extends into the first elastic member 28. The third movable member 64 is provided with a fifth screwing portion 641 screwed with the fourth screwing portion 632 so that the third movable member 64 is assembled with the second movable member 63. The fifth screwing portion 641 is an external thread. The third movable member 64 is a circular rod.

The limit member 65 is assembled with the second body 20. The limit member 65 has a first end received in the first receiving hole 24 and a second end slidably mounted in the second guide slot 613. The limit member 65 is arranged between the first receiving hole 24 and the second guide slot 613. The limit member 65 is slidable in the second guide slot 613. The first movable member 611 cannot be rotated relative to the second body 20 by restriction of the limit member 65. Thus, the first movable member 61 cannot be rotated relative to the second body 20 by restriction of the first sensor 62 and the limit member 65.

The display unit 70 is assembled with the second body 20 and aligns with the first guide slot 25. When the mobile unit 60 is operated in the second body 20, the display unit 70 senses or detects the position of the mobile unit 60, or when the first sensor 62 is moved linearly in the first guide slot 25, the display unit 70 senses or detects the position of the first sensor 62, so that the display unit 70 indicates the torque value. The display unit 70 indicates the torque value at a digital state. The display unit 70 includes a display member 71, a second sensor (or detector) 72, a base 73, and multiple fastening members 74.

The display member 71 is mounted on the first guide slot 25. The first guide slot 25 is hidden in the display member 71. The display member 71 is provided with a third indication portion 711. The third indication portion 711 indicates the torque value of the torque structure in a digital or number manlier.

The second sensor 72 is received in the display member 71. The second sensor 72 senses or detects a position of the first sensor 62 in the first guide slot 25, to sense or detect the compression extent of the first elastic member 28 in the second body A. The information detected by the second sensor 72 is indicated on the third indication portion 711 of the display member 71.

The base 73 is assembled with the display member 71. The second sensor 72 and the second body 20 are encompassed by the display member 71 and the base 73.

The fastening members 74 extend through the base 73 and are screwed into the display member 71, so that the display unit 70 is assembled with the second body 20. The display unit 70 includes four fastening members 74, Each of the fastening members 74 is a bolt or threaded rod.

Referring to FIGS. 10-13 with reference to FIGS. 1-9, the second body 20 is assembled with the first body 10. The first elastic member 28 is received in the second body 20. The control unit 30 is mounted on the first body 10 and movable between a locking position where the first body 10 cannot be rotated relative to the second body 20, and an unlocking position where the first body 10 can be rotated relative to the second body 20. The retaining unit 40 is assembled with the second body 20. The adjusting unit 50 is assembled with the first body 10. The adjusting unit 50 extends through the first receiving chamber 11 and the retaining unit 40. The mobile unit 60 is received in the second body 20 and has an end resting on the second washer 53. The first sensor 62 is arranged between the first guide slot 25 and the second receiving hole 612. The limit member 65 is arranged between the first receiving hole 24 and the second guide slot 613. The first movable member 61 cannot be rotated relative to the second body 20 by restriction of the first sensor 62 and the limit member 65. The display unit 70 is assembled with the second body 20. The second sensor 72 is received in the display member 71. The fastening members 74 extend through the base 73 and are screwed into the display member 71, so that the display member 71 and the base 73 of the display unit 70 are assembled with and cannot be detached from the second body 20.

In operation, referring to FIGS. 14-16 with reference to FIGS. 1-13, when the first body 10 is rotated relative to the second body 20, the first body 10 drives the adjusting member 51 which drives the first screwing portion 511 which is rotated and moved in the engaging portion 411, so that the adjusting member 51 is rotated and moved relative to the retaining unit 40. Then, the adjusting member 51 drives the mobile unit 60 to move linearly in the second body 20 so that the first movable member 61 presses the first elastic member 28, to adjusts the compression extent of the first elastic member 28 so as to regulate the torque value of the torque structure. The first sensor 62 is driven by the first movable member 61 to slide in the first guide slot 25, and the second sensor 72 senses or detects the position of the first sensor 62 in the first guide slot 25, so that the third indication portion 711 of the display member 71 indicates the torque value of the torque structure.

Figure 17:
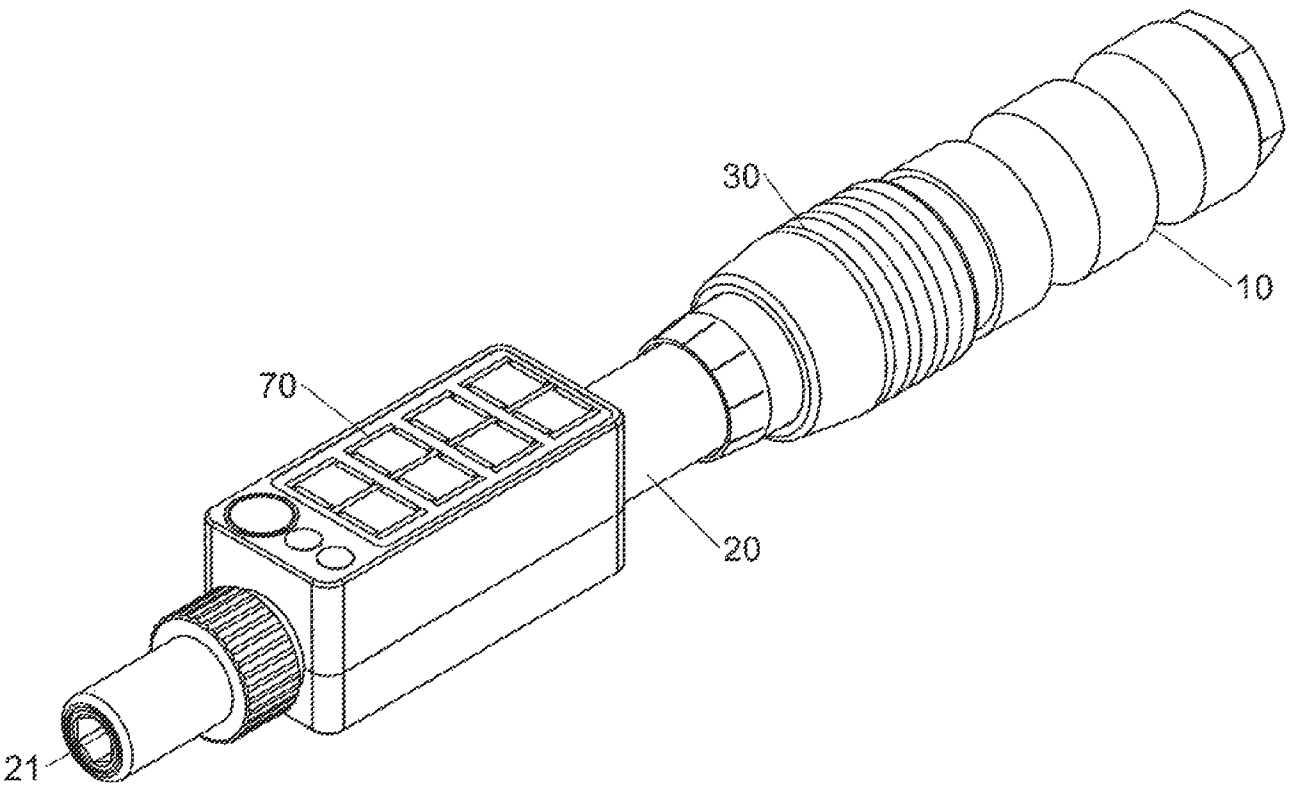
FIG. 17 is a perspective view of a torque structure in accordance with a second preferred embodiment of the present invention.

Referring to FIG. 17, the drive portion 21 is a hexagonal recess. The first body 10 is rotated about the axis of the first body 10 to drive the second body 20. Thus, when the second body 20 is rotated about the axis of the second body 20, the second body 20 has a torque slip effect.

Figure 18:
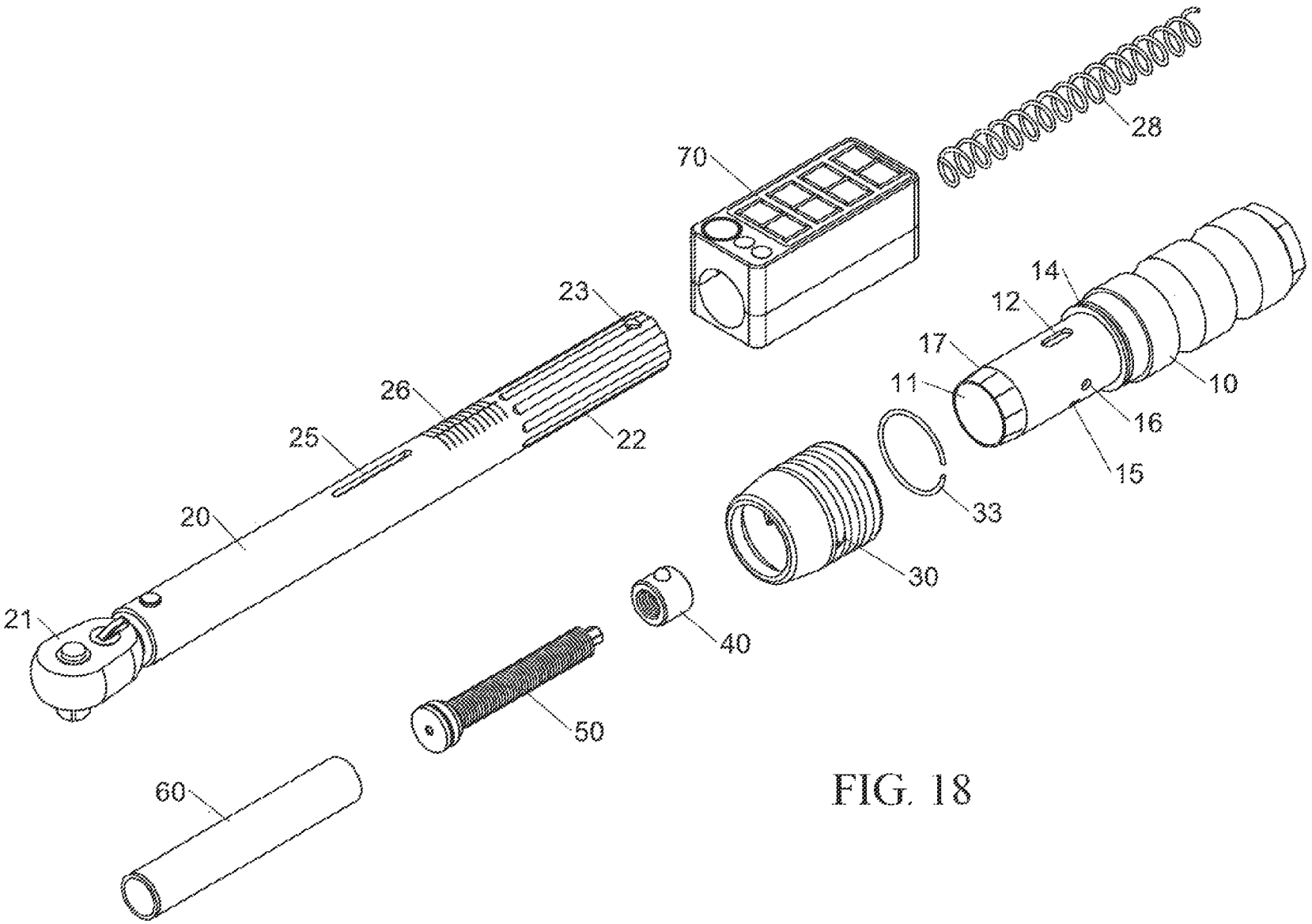
FIG. 18 is an exploded perspective view of a torque structure in accordance with a third preferred embodiment of the present invention.
Figure 19:
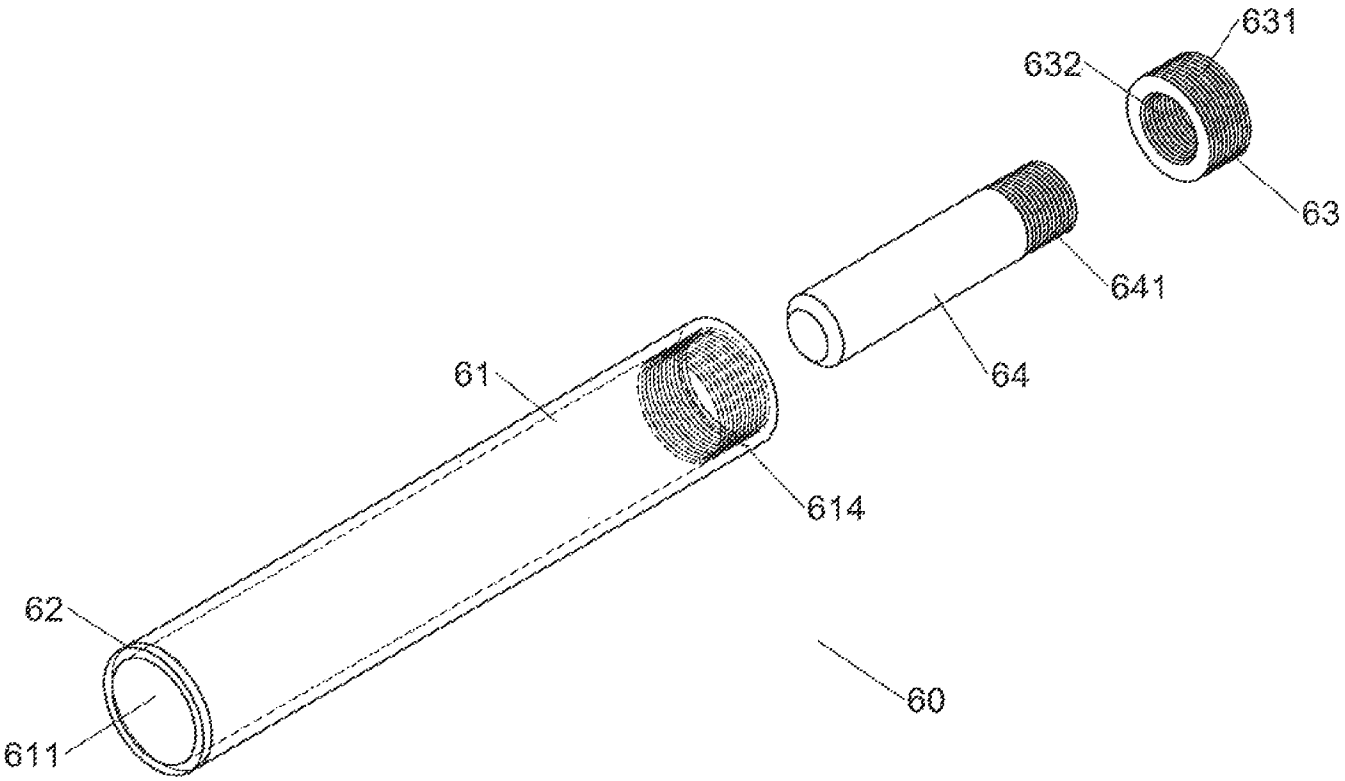
FIG. 19 is an exploded perspective view of a mobile unit of the torque structure in accordance with the third preferred embodiment of the present invention.

Referring to FIGS. 18 and 19 with reference to FIGS. 1-10, the first receiving hole 24 of the second body 20 is undefined, the limit member 65 of the mobile unit 60 is undefined, and the second receiving hole 612 and the second guide slot 613 of the first movable member 61 are undefined. The first movable member 61 and the first sensor 62 are formed integrally. Thus, the mobile unit 60 is not restricted by the first sensor 62 and the limit member 65 and is moved freely in the second body 20. The first sensor 62 is made of coating material and has a color different from that of the first movable member 61 so that the second sensor 72 identifies the position of the first sensor 62.

Thus, the characteristic of the present invention is in that, the adjusting unit 50 is rotated and moved, the mobile unit 60 is moved linearly and the display unit 70 senses or detects displacement of the mobile unit 60. In addition, the mobile unit 60 is arranged between the adjusting unit 50 and the display unit 70 so that the display unit 70 indicates the torque value of the torque structure.

Accordingly, the torque structure of the present invention has the following advantages.

1. The display unit 70 indicates the torque value at a digital state to facilitate the user inspecting the torque value.
2. The mobile unit 60 is moved with the adjusting unit 50, and the display unit 70 senses or detects the position of the mobile unit 60, to indicate the torque value of the torque structure.
3. When the adjusting unit 50 moves in one direction, the mobile unit 60 is moved with the adjusting unit 50, and when the adjusting unit 50 moves in the other direction, the mobile unit 60 is returned to the original position by the restoring force of the first elastic member 28.
4. The first body 10 has a greater volume and length and satisfies an ergonomic design to provide a better rotation force so that the user's palm directly holds and rotates the first body 10.
5. The second sensor 72 detects the position of the first sensor 62, to detect the compression extent of the first elastic member 28. The information detected by the second sensor 72 is indicated on the third indication portion 711. Thus, the display unit 70 indicates the torque value of the torque structure.
6. The third indication portion 711 indicates the torque value of the torque structure in a digital manner, to facilitate the user watching and identifying the torque value of the torque structure.
7. The first indication portion 17 includes multiple scales that are arranged annularly, and the second indication portion 26 includes multiple scales arranged linearly in the lengthwise direction of the second body 20. When the adjusting unit 50 is driven by the first body 10, the first indication portion 17 is rotated and moved on the second body 20 so that the scales of the first indication portion 17 align with the scales of the second indication portion 26, to indicate the compression extent of the first elastic member 28, and to indicate the torque value of the torque wrench.
8. The torque value of the torque structure is indicated at two places to facilitate the user deriving the torque value of the torque structure.
9. The first movable member 61 is limited by the first sensor 62 and cannot be rotated relative to the second body 20, so that the mobile unit 60 is moved linearly along the first guide slot 25, and the torque value is detected easily.
10. The first movable member 61 is limited by the limit member 65 and cannot be rotated relative to the second body 20, so that the mobile unit 60 is moved linearly along the second guide slot 613, and the torque value is detected easily.
11. The first sensor 62 restricts the first movable member 61 to move linearly in the second body 20, and cooperates with the second sensor 72 to detect the compression extent of the first elastic member 28 in the second body 20, so that the first sensor 62 has a double function.
12. The display member 71 and the base 73 are assembled or disassembled easily and quickly by screwing or unscrewing the fastening members 74, to facilitate the operator cleaning, repairing or replacing the parts of the display unit 70.
13. The first indication portion 17, the second indication portion 26, and the display unit 70 are arranged at the middle position of the torque structure, so that the user directly watches the first indication portion 17, the second indication portion 26, and the display unit 70 when holding and rotating the first body 10, so as to identify the torque value quickly.
14. The first washer 52 is arranged between the adjusting member 51 and the fixed seat 41 to prevent the adjusting member 51 from hitting the fixed seat 41 during a linear displacement of the adjusting member 51.
15. The second washer 53 is arranged between the adjusting member 51 and the mobile unit 60 to prevent from incurring a rubbing or wear between the adjusting member 51 and the mobile unit 60.

16. As shown in FIGS. 18 and 19, the first receiving hole 24 of the second body 20 is undefined, the limit member 65 of the mobile unit 60 is undefined, the second receiving hole 612 and the second guide slot 613 of the first movable member 61 are undefined, and the first movable member 61 and the first sensor 62 are formed integrally, to reduce the cost of the torque structure.
17. When the control sleeve 31 is moved to the unlocking position, the first body 10 can be rotated relative to the second body 20, so that the positioning member 34 is moved on the second body 20 and positioned in any one of the positioning channels 22. When the positioning member 34 is moved from one to another one of the positioning channels 22, the positioning member 34 is pressed inward by the restoring force of the second ring 35, so that the positioning member 34 is retracted into another one of the positioning channels 22. Thus, a clear sound is produced when the positioning member 34 is forced into and locked in each of the positioning channels 22 to provide an audio indication to facilitate the user noticing the rotation state of the adjusting unit 50 during adjustment of the torque value, and to remind the user that the positioning member 34 is already locked in one of the positioning channels 22. Then, the control sleeve 31 is returned to the locking position after the torque is adjusted to the required value.
18. The second elastic member 32 is a spring elastically biased against the control sleeve 31 to push the control sleeve 31 from the unlocking position to the locking position.
19. The fixed seat 41 is a single element that is worked easily to reduce the cost. Alternatively, the fixed seat 41 is formed by injection molding, and is then drilled to form the second securing portions 412.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A torque structure comprising:
a first body, a second body, a first elastic member, a retaining unit, an adjusting unit, a mobile unit, and a display unit;
wherein:
the first body has an interior provided with a first receiving chamber;
the second body is assembled with the first body;
the second body is partially received in the first receiving chamber;
the second body has a first end provided with a drive portion;
the second body is provided with a first guide slot extending in a lengthwise direction of the second body;
the first elastic member is received in and elastically pressing the second body;
the retaining unit is assembled with the second body;
the retaining unit is not moved or rotated relative to the second body;
the adjusting unit is assembled with the first body, the second body, and the retaining unit;
when the first body is rotated relative to the second body, the first body drives the adjusting unit to rotate and move relative to the retaining unit, so that the adjusting unit is moved axially in the second body;
the mobile unit is received in the second body and aligns with the first guide slot;
the first elastic member is elastically biased between the second body and the mobile unit;
the mobile unit is mounted between the first elastic member and the adjusting unit;
when the first body drives the adjusting unit to rotate and move, the adjusting unit pushes and moves the mobile unit, so that the mobile unit adjusts a compression extent of the first elastic member;
the display unit is assembled with the second body and aligns with the first guide slot;
when the mobile unit is operated in the second body, the display unit senses or detects a position of the mobile unit and indicates a torque value;
the second body is provided with a first receiving hole having a circular shape and hidden in the first receiving chamber;
the mobile unit includes a first movable member, a first sensor, and a second movable member;
the first movable member is received in the second body and provided with a second receiving chamber;
the first elastic member is received in the second receiving chamber;
the first movable member is provided with a second receiving hole aligning with the first guide slot;
the first sensor is assembled with the first movable member;
the first sensor has a first end mounted in the second receiving hole and a second end slidably mounted in the first guide slot;
the first sensor slides linearly in the first guide slot;
the mobile unit is moved linearly by restriction of the first sensor;
the second movable member is assembled with the first movable member;
the first elastic member is elastically biased between the second body and the second movable member of the mobile unit;
when the first sensor is moved linearly in the first guide slot, the display unit senses the position of the first sensor;
the display unit includes a display member, a second sensor, a base, and multiple fastening members;
the display member is mounted on the first guide slot;
the first guide slot is hidden in the display member;
the display member is provided with a third indication portion;
the third indication portion indicates the torque value of the torque structure in a digital manner;
the second sensor is received in the display member;
the second sensor senses a position of the first sensor in the first guide slot, to detect the compression extent of the first elastic member in the second body;
an information detected by the second sensor is indicated on the third indication portion of the display member;
the base is assembled with the display member;
the fastening members extend through the base and are screwed into the display member, so that the display unit is assembled with the second body; and
each of the fastening members is a bolt.

2. The torque structure as claimed in claim 1, wherein:
the first receiving chamber has a circular shape;
the first body is provided with a slot connected to the first receiving chamber;

the slot of the first body has an elongate shape;
the first body is provided with a first annular groove;
the first body is provided with two receiving recesses that are symmetrical relative to the slot of the first body;
the first body is provided with a ball hole connected to the first receiving chamber;
the ball hole has a circular shape;
the second body has a second end having a peripheral face provided with a plurality of positioning channels hidden in the first receiving chamber;
the positioning channels are arranged annularly about an axis of the second body and are spaced from each other;
each of the positioning channels has an arcuate shape;
the positioning channels are distant from the drive portion; and
the first guide slot is located between the drive portion and the positioning channels and has an elongate shape.

3. The torque structure as claimed in claim 1, wherein:
the first body is provided with a first indication portion including multiple scales that are arranged annularly and spaced from each other;
the second body is provided with a second indication portion including multiple scales arranged linearly in the lengthwise direction of the second body; and
the first body is rotated relative to the second body until the scales of the first indication portion align with the scales of the second indication portion.

4. The torque structure as claimed in claim 1, wherein:
the drive portion protrudes from the first body;
the second body is provided with a plurality of first securing portions arranged on the positioning channels;
the first securing portions are arranged annularly about the axis of the second body and are spaced from each other;
each of the first securing portions is a circular hole and hidden in the first receiving chamber;
the retaining unit is received in the second body and includes a fixed seat, and a plurality of securing members;
the fixed seat has a tubular shape and is assembled with the second body;
the fixed seat is not moved or rotated relative to the second body;
the fixed seat is hidden in the second body and distant from the drive portion;
the fixed seat is provided with an engaging portion extending through the fixed seat;
the engaging portion is a circular internal thread;
the fixed seat is provided with a plurality of second securing portions aligning with the first securing portions;
the securing members are mounted on the first securing portions and the second securing portions;
each of the securing members is a ball;
the adjusting unit includes an adjusting member, a first washer, and a second washer;
the adjusting member is mounted in the second body and extends through the engaging portion;
the adjusting member is rotated and moved in the second body and extends through the engaging portion;
the adjusting member is provided with a first screwing portion;
the first screwing portion is partially received in the second body and engages the engaging portion;
the adjusting member is assembled with the first body;
when the first body is rotated relative to the second body, the first body drives the adjusting member which drives the first screwing portion which is rotated and moved in the engaging portion;
the first screwing portion is an external thread;
the adjusting member has a first end provided with a mounting portion received in the first receiving chamber;
the mounting portion has a hexagonal shape;
the first washer is received in the second body;
the first washer is mounted on the adjusting member and rests on a second end of the adjusting member;
the first washer is arranged between the adjusting member and the fixed seat;
the second washer is received in the second body and rests on the second end of the adjusting member;
the second washer is spaced from the first washer; and
the second washer is a disk.

5. The torque structure as claimed in claim 2, further comprising:
a control unit mounted on the first body and movable between a locking position where the first body cannot be rotated relative to the second body, and an unlocking position where the first body can be rotated relative to the second body.

6. The torque structure as claimed in claim 5, wherein:
the control unit includes a control sleeve, a second elastic member, a first ring, a positioning member, a second ring, and a ball;
the control sleeve is mounted on the first body and movable axially on the first body between a locking position and an unlocking position;
the control sleeve has an interior provided with a spring recess;
the spring recess has a bottom provided with a abutting edge;
the control sleeve is provided with a first peripheral face and a second peripheral face;
the abutting edge is arranged between the spring recess and the first peripheral face;
the first peripheral face has a diameter less than that of the spring recess and is arranged between the abutting edge and the second peripheral face;
the second peripheral face has a diameter more than that of the first peripheral face;
the control sleeve is provided with a first conic groove which is arranged between the first peripheral face and the second peripheral face and is enlarged from the first peripheral face to the second peripheral face;
the first peripheral face is arranged between the abutting edge and the first conic groove;
the control sleeve is provided with a second conic groove which is arranged in the spring recess;
the second conic groove is enlarged from the opening of the spring recess to the abutting edge;
the abutting edge is arranged between the first peripheral face and the second conic groove;
the second elastic member is mounted on the first body and elastically biased against the control sleeve to push the control sleeve from the unlocking position to the locking position;
the second elastic member is received in the spring recess and has a first end elastically pressing the first body and a second end elastically pressing the abutting edge;
the first ring is mounted in the first annular groove and hidden in the control sleeve;
the first ring is elastically expandable outward;

the first ring rests on a peripheral face of the spring recess when the control sleeve is moved axially to the locking position, and is expanded outward to rest on the second conic groove when the control sleeve is moved axially to the unlocking position;

the positioning member has a cylindrical shape;

the positioning member is received in the slot of the first body and hidden in the control sleeve;

the positioning member is releasably locked in one of the positioning channels;

the positioning member is provided with a second annular groove;

the second ring is mounted on the first body and the second annular groove and has an elastic restoring force;

the second ring has two receiving portions received in the two receiving recesses so that the second ring is secured to the first body;

the positioning member is limited by the second ring;

the ball is received in the ball hole and hidden in the control sleeve;

the ball rests on the first conic groove of the control sleeve; and the control sleeve is limited by the ball.

7. The torque structure as claimed in claim 6, wherein:

when the control sleeve is situated at the locking position, the second elastic member pushes the control sleeve toward the first pivot portion, so that the first ring rests on the peripheral face of the spring recess;

one end of the positioning member is pressed by the first peripheral face, and the positioning member is partially retracted into the slot of the first body, so that the positioning member is locked in one of the positioning channels;

the first body and the second body are locked by the positioning member, so that the first body cannot be rotated relative to the second body;

the other end of the positioning member aligns with the second peripheral face and the first conic groove, and the ball partially protrudes from the ball hole and rests on the first conic groove;

when the control sleeve is moved on the first body in a direction opposite to the second body toward the unlocking position, the second elastic member is compressed by the abutting edge, and the first ring is detached from the peripheral face of the spring recess so that the first ring is expanded outward and rests on the second conic groove, and the control sleeve is situated at the unlocking position by the first ring;

one end of the positioning member is detached from the first peripheral face, the positioning member is restricted by the second ring, and the ball is distant from the first conic groove, so that the first body can be rotated relative to the second body, and the positioning member is moved on the second body and positioned in any one of the positioning channels;

the positioning member is pushed by the wall of the second body, and the second ring is pushed and expanded outward by the positioning member when the first body is rotated relative to the second body; and when the positioning member is moved from one to another one of the positioning channels, the positioning member is pressed inward by the restoring force of the second ring, so that the positioning member is retracted into another one of the positioning channels.

8. The torque structure as claimed in claim 1, wherein:

the mobile unit is moved linearly;

the mobile unit is rotated and moved in the second body; and when the adjusting unit moves in one direction, the mobile unit is moved with the adjusting unit, and when the adjusting unit moves in the other direction, the mobile unit is returned to an original position by a restoring force of the first elastic member.

9. The torque structure as claimed in claim 1, wherein:

the second receiving chamber extends through the first movable member and has a circular shape;

the second receiving hole has an axis perpendicular to that of the first movable member;

the second receiving hole has a circular shape;

the first movable member is provided with a second guide slot aligning with the first receiving hole;

the second guide slot has an elongate shape and extends in a lengthwise direction of the first movable member;

the second receiving chamber is provided with a second screwing portion distant from the second receiving hole;

the second guide slot is arranged between the second receiving hole and the second screwing portion;

the second screwing portion is an internal thread;

the first movable member has a tubular shape;

the second movable member is hidden in the first movable member;

the second movable member has an outer peripheral face provided with a third screwing portion screwed with the second screwing portion so that the second movable member is secured to the first movable member;

the third screwing portion is an external thread;

the second movable member has an inner peripheral face provided with a fourth screwing portion;

the fourth screwing portion is an internal thread;

the mobile unit further includes a third movable member received in the second receiving chamber and extends into the first elastic member;

the third movable member is provided with a fifth screwing portion screwed with the fourth screwing portion so that the third movable member is assembled with the second movable member;

the fifth screwing portion is an external thread;

the third movable member is a circular rod;

the mobile unit further includes a limit member;

the limit member is assembled with the second body;

the limit member has a first end received in the first receiving hole and a second end slidably mounted in the second guide slot;

the limit member is arranged between the first receiving hole and the second guide slot;

the limit member is slidable in the second guide slot; and the first movable member cannot be rotated relative to the second body by restriction of the limit member.

10. The torque structure as claimed in claim 1, wherein the drive portion is a hexagonal recess, and the first body is rotated about the axis of the first body to drive the second body.

11. The torque structure as claimed in claim 1, wherein the first movable member and the first sensor are formed integrally, and the first sensor is made of coating material and has a color different from that of the first movable member.

* * * * *